United States Patent [19]

Arneson

[11] Patent Number: 4,800,605

[45] Date of Patent: Jan. 31, 1989

[54] BUFFING APPARATUS

[76] Inventor: Howard M. Arneson, 6 Locksley La., San Rafael, Calif. 94901

[21] Appl. No.: 91,694

[22] Filed: Aug. 31, 1987

Related U.S. Application Data

[63] Continuation-in-part of Ser. No. 790,300, Oct. 23, 1985, Pat. No. 4,691,400, which is a continuation-in-part of Ser. No. 502,433, Jun. 9, 1983, Pat. No. 4,566,144.

[51] Int. Cl.[4] ..... A47L 23/00

[52] U.S. Cl. ..... 15/3; 15/90; 15/97 R; 15/210 R; 51/7; 51/164.1; 51/164.5; 68/235 R

[58] Field of Search ..... 15/1, 3, 3.1, 90, 94, 15/97 R, 97 A, 210 R, 104 R, 209 R, 257 R; 68/213, 235 R; 134/6; 51/7, 163.1, 164, 164.1, 164.5

[56] References Cited

U.S. PATENT DOCUMENTS 1,352,598 9/1920 Hart ..... 51/164.5 X
1,747,324 2/1930 Savitt ..... 15/90 X
2,912,803 11/1959 Simjian ..... 15/3

FOREIGN PATENT DOCUMENTS 246157 2/1911 Fed. Rep. of Germany .
538333 2/1971 Switzerland .
0626941 8/1978 U.S.S.R. ..... 51/164.5

*Primary Examiner*—Edward L. Roberts
*Attorney, Agent, or Firm*—Townsend and Townsend

[57] ABSTRACT

Apparatus and method for buffing articles, such as leather goods, silverware and the like. The apparatus includes a flexible container for receiving an article to be buffed. The interior of the container has a buffing material therein and is of a size to permit relative movement of the article and the buffing material so that, when the container is moved about, such as in the drum of a clothes dryer, the article and the buffing material move continuously into frictional engagement with each other causing a buffing action to occur. Several embodiments of the container are disclosed. A clothes dryer can be used for moving the container. In the alternative, a coin operated drum can be provided.

11 Claims, 9 Drawing Sheets

BUFFING APPARATUS

This application is a continuation-in-part patent application of application Ser. No. 790,300, filed Oct. 23, 1985, now U.S. Pat. No. 4,691,400 which was a continuation-in-part patent application of application Ser. No. 502,433, filed June 9, 1983 now U.S. Pat. No. 4,566,144.

This invention relates to improvements in the buffing of articles and, more particularly, to buffing apparatus which provides a buffing action to articles of different types in a minimum of time and without operator attention.

BACKGROUND OF THE INVENTION

It is well known that shoes are generally shined by brushing them by hand with a bristle brush or buffing them with a cloth of a suitable buffing material. This requires a considerable amount of energy and time for busy people who consider this an inconvenience, especially if they have other things to accomplish in a given day. Moreover, to hold a shoe in one hand while the shoe is being brushed by a brush in the other hand causes both hands to become soiled or dirty, requiring that the hands be washed immediately afterwards.

Buffing a shoe with a buffing cloth requires the shoe to be worn or to be mounted on a fixed support. It is no wonder that shining of shoes is simply a job which is put off for much too long a time. Eventually, the appearance of the person wearing the shoes suffers and requires some sort of immediate action which the wearer does not wish to do.

While it is possible to get shoe shines at a shoe shine stand, these are found only at locations in a commercial area, such as in a downtown area or at an airport. A professional shoe shine costs money and takes time because the shoes typically remain on the feet of the wearer while being shined. This also is time consuming and an inconvenience which is to be avoided generally.

Because of these drawbacks, a need has arisen for improvements in the buffing of articles, such as shoes and goods of various types.

SUMMARY OF THE INVENTION

This present invention satisfies the aforesaid need by providing an improved buffing apparatus wherein the apparatus is simple in construction and the method is easy to practice. Moreover, the invention permits the buffing of articles of different types without operator attention. Thus, during the buffing operation, the user can turn his attention to other tasks and need not be present while the buffing action is taking place.

The apparatus of the present invention provides a holder or container for receiving the article or articles to be buffed, the container being closeable after the article is therewithin. Also, within the container is a buffing material which buffs and thereby shines the article as the container is moved about, such as when the container tumbles about or rotates within a shiftable bin, such as the rotary drum of a conventional clothes dryer.

In one form of the invention, the container has a flexible bag therewithin for receiving the article or articles to be buffed. The bag, which may be of buffing material also has one or more buffing elements therewithin, each element being a soft vinyl ball or hollow member having buffing material means thereon. The bag is of a sufficient size to allow relative movement between the buffing element and the article in the bag as the container itself moves about. The relative movements of the element and the article cause the buffing material means of the element to buff or shine the article in a minimum of time. During this time, the container is being moved about continuously and without the need for user attention. Thus, the user can turn his attention to other tasks and not need to be present during the buffing operation.

In the buffing of a pair of shoes, for instance, each shoe is prepared for buffing by applying a polish or wax to it. Then, the shoe is inserted into a bag with one or more buffing elements. The polish or wax may be omitted, if desired. Usually only a single shoe is placed in the bag although a pair of shoes can be placed in the same bag if the bag is large enough. In the alternative, two such bags can be used in the container for a pair of shoes, assuming the container is large enough to accommodate both bags.

Once the movement of the container starts, the user can walk away from the buffing location and do other things. Usually in 5 to 15 minutes, a shoe or pair of shoes will be properly buffed to provide a high gloss to the surfaces of the shoes.

Various other features of the apparatus include the use of weights in the container to effectively cause a higher degree of frictional engagement between the buffing material and the article to be buffed. This feature assures the proper amount of buffing action for a particular article. Moreover, the container itself can be moved about randomly within a shiftable bin such as a rotary bin as the bin rotates. In the alternative, the container can be held in fixed position in a shiftable bin with the container spaced inwardly from or against the inner periphery of the bin, depending upon the way in which it is desired that the container be moved about in buffing the articles in the container.

Another feature of the present invention is the provision of a shiftable bin that is coin actuated so that the bin and the container can be placed in a commercial establishment for shining of shoes. This feature does not require any operator attention, and customers can shine their shoes quickly and easily without doing anything more than taking off their shoes and placing them into the container and into the shiftable bin and then actuating the bin.

The primary object of the present invention is to provide an improved buffing apparatus for use in buffing articles of different types, including shoes, wherein the apparatus includes a container for receiving an article to be buffed and the container is provided with buffing material therewithin for frictional engagement with the article so that that, as the container is moved about, such as when the container is rotated or tumbled in a rotary bin, the article and the buffing material are moved relative to each other so that the exposed surfaces of the article can be buffed to a high gloss without requiring any effort on the part of the user of the invention except to put the article into and take the article out of the container.

Other objects of this invention will become apparent as the following specification progresses, reference being had to the accompanying drawings for an illustration of the invention.

IN THE DRAWINGS

Figure 1:
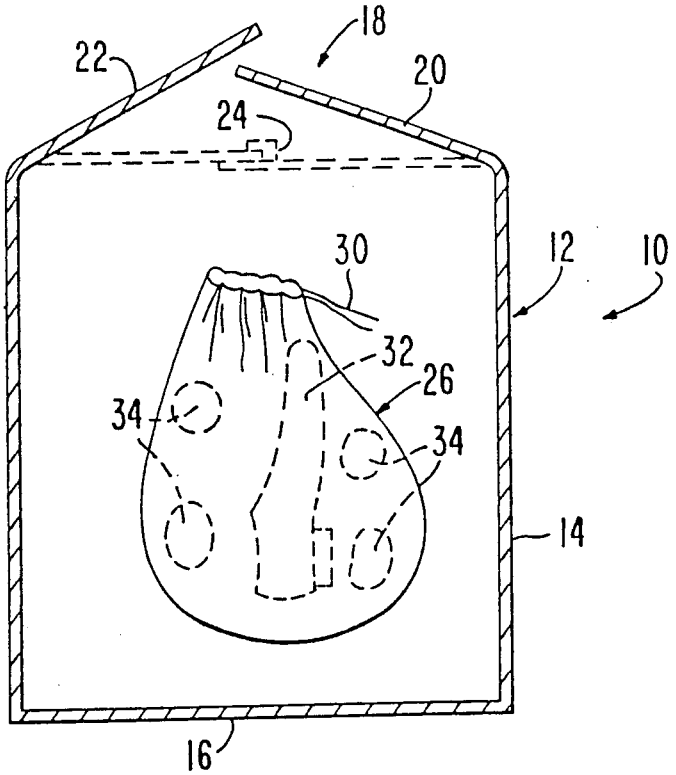
FIG. 1 is a vertical section through a container having a bag containing a shoe to be buffed and a number of buffing elements and forming one embodiment of the present invention.
Figure 2:
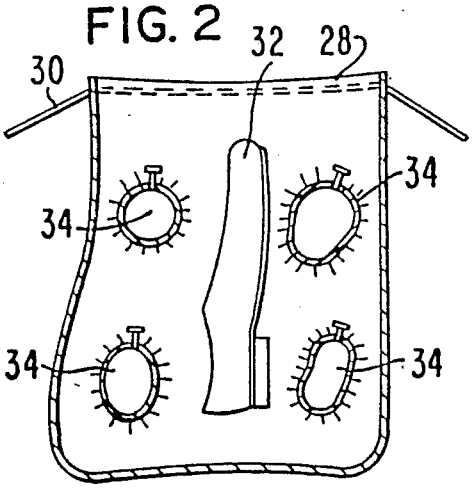
FIG. 2 is a cross-sectional view of a bag usable with the container of FIG. 1.
Figure 3:
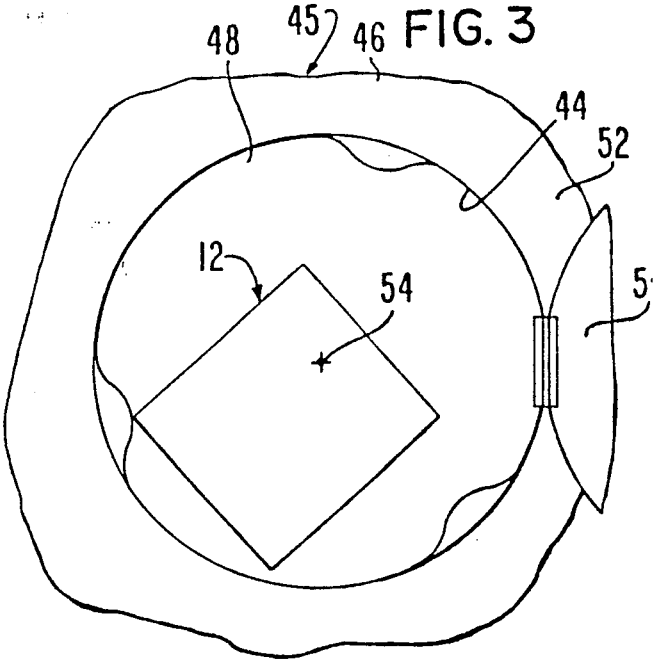
Figure 2A:
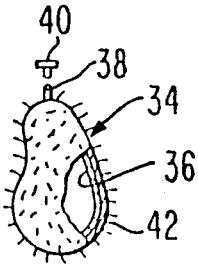
Figure 4:
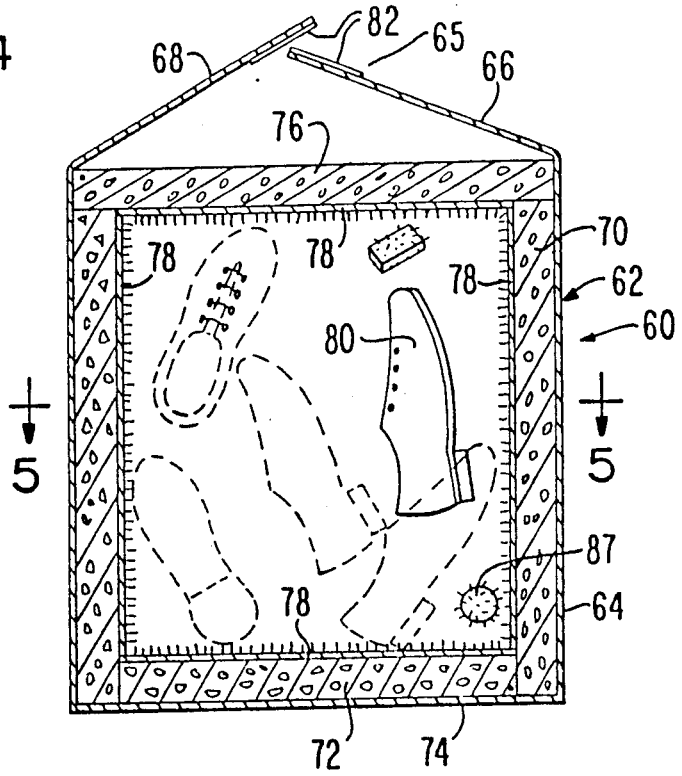
Figure 5:
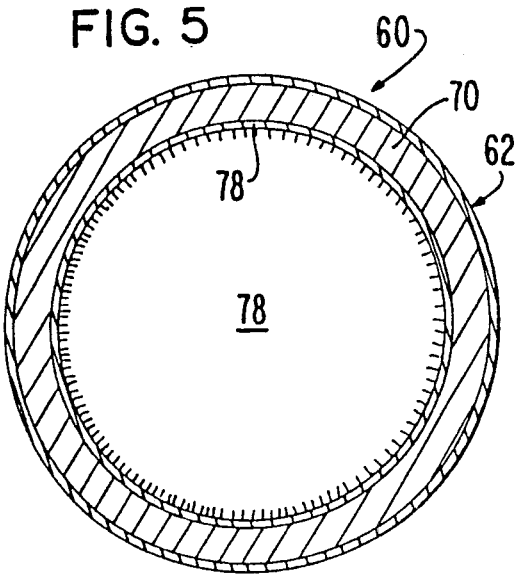
Figure 6:
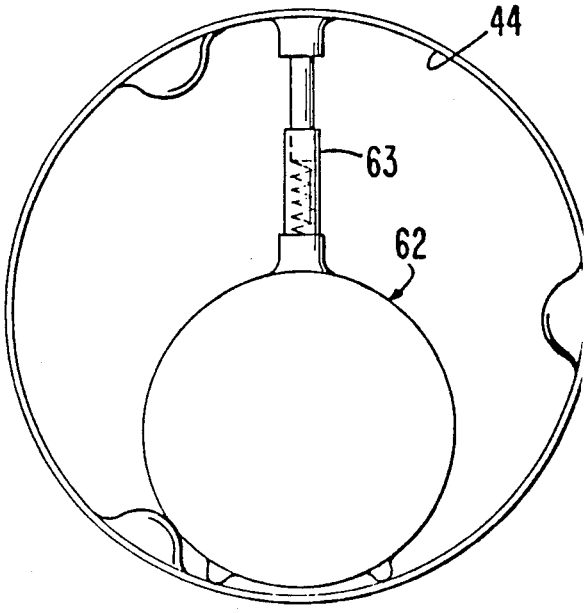
Figure 7:
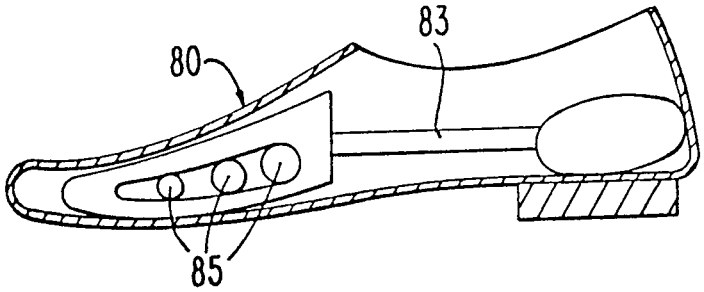
Figure 8:
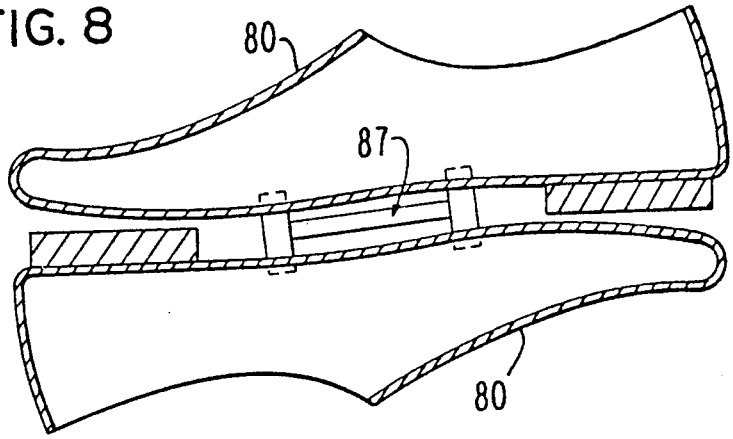
Figure 9:
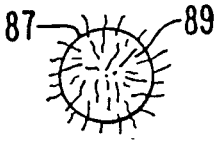
Figure 10:
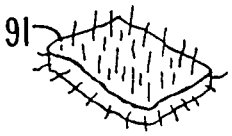
Figure 11:
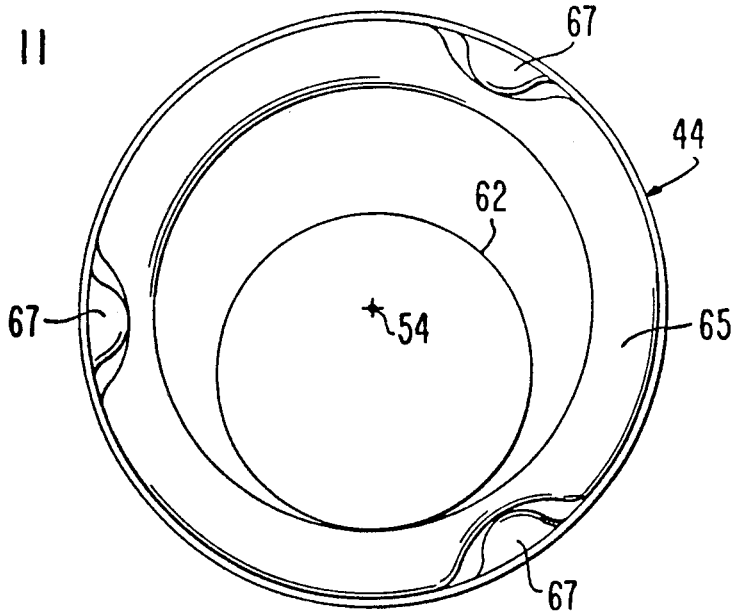
Figure 12:
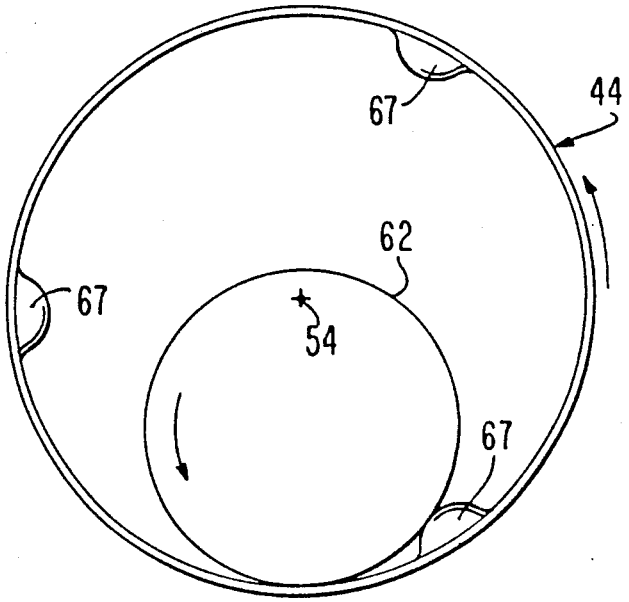
Figure 13:
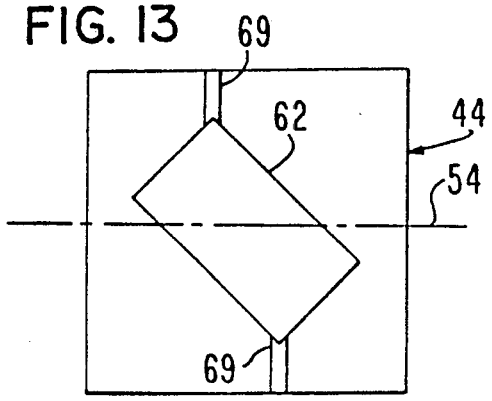
Figure 14:
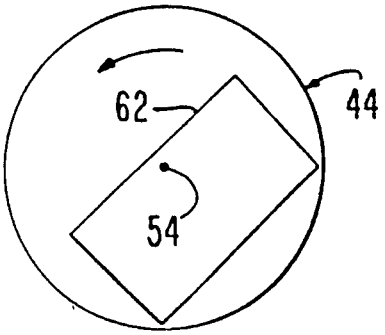
Figure 15:
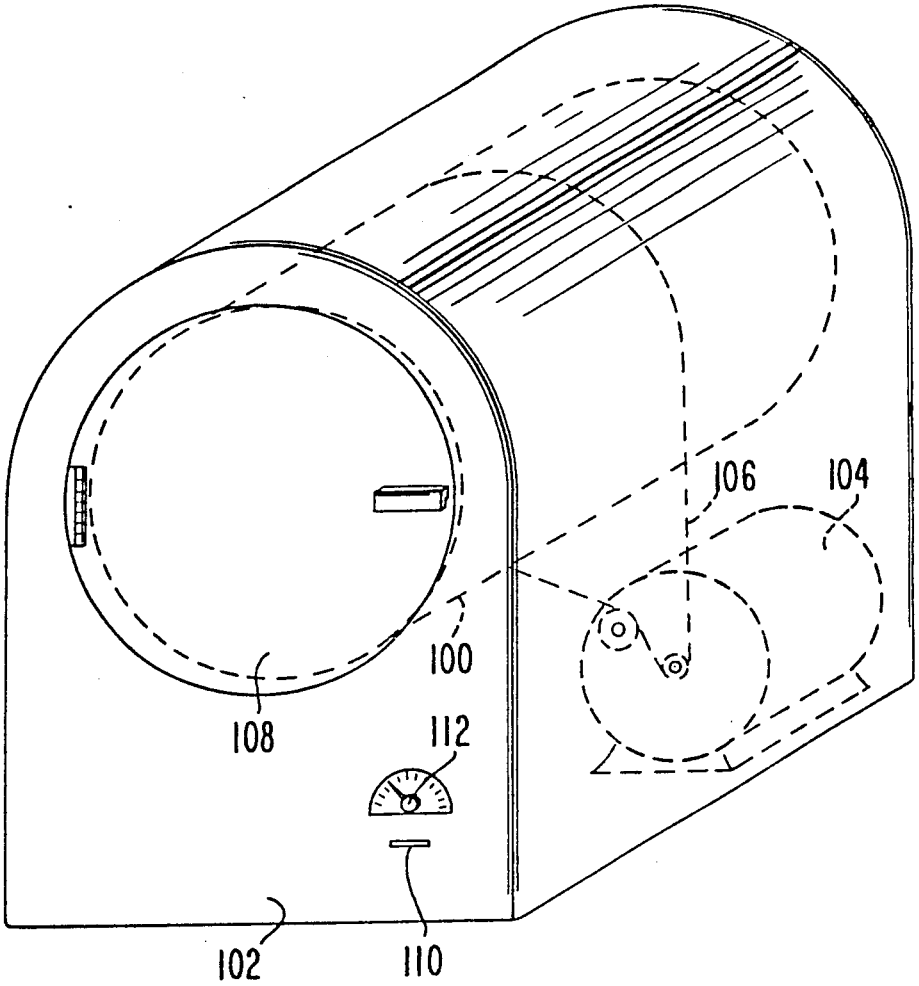

FIG. 2*a* is a side elevational view, partly in section, of one of the buffing elements for insertion in the bag of FIG. 2;

FIG. 3 is a fragmentary, front elevational view of a rotary bin, such as a conventional rotary clothes dryer, for receiving the container of FIG. 1;

FIG. 4 is a view similar to FIG. 1 but showing a second embodiment of the container with a shoe therewithin;

FIG. 5 is a cross-sectional view taken along line 5—5 of FIG. 4;

FIG. 6 is a view similar to FIG. 3 but showing the way in which a container, such as the container of FIGS. 1 and 4, can be held in a rotary bin, such as the rotary drum of a conventional clothes dryer;

FIG. 7 is a vertical section through a shoe having a shoe tree provided with weights, the shoe being of the type for insertion into the containers of FIGS. 1 and 4;

FIG. 8 is a view similar to FIG. 7 but showing a pair of shoes coupled together for placement in the container of FIG. 4;

FIGS. 9 and 10 are perspective views of buffing elements which can be placed in the container of FIG. 4 to increase the buffing action on a shoe in the container as the container is shifted about;

FIG. 11 is a view similar to FIGS. 3 and 6 but showing the way in which the drum of a rotary clothes dryer can be provided with an inflatable element to cover the inner peripheral projections thereof;

FIG. 12 is a view similar to FIG. 11 showing the rotary drum without the inflatable member;

FIG. 13 is a schematic, side elevational view of a shiftable bin having a container of the type shown in FIG. 4 held by a pair of end braces in the bin;

FIG. 14 is a view similar to FIGS. 1, 3, 11 and 12 but showing a container placed against the inner periphery of a rotary bin;

FIG. 15 is a perspective view of a coin operated rotary drive apparatus having a front opening and adapted for use in commercial establishments for buffing shoes and other articles.

Figure 16:
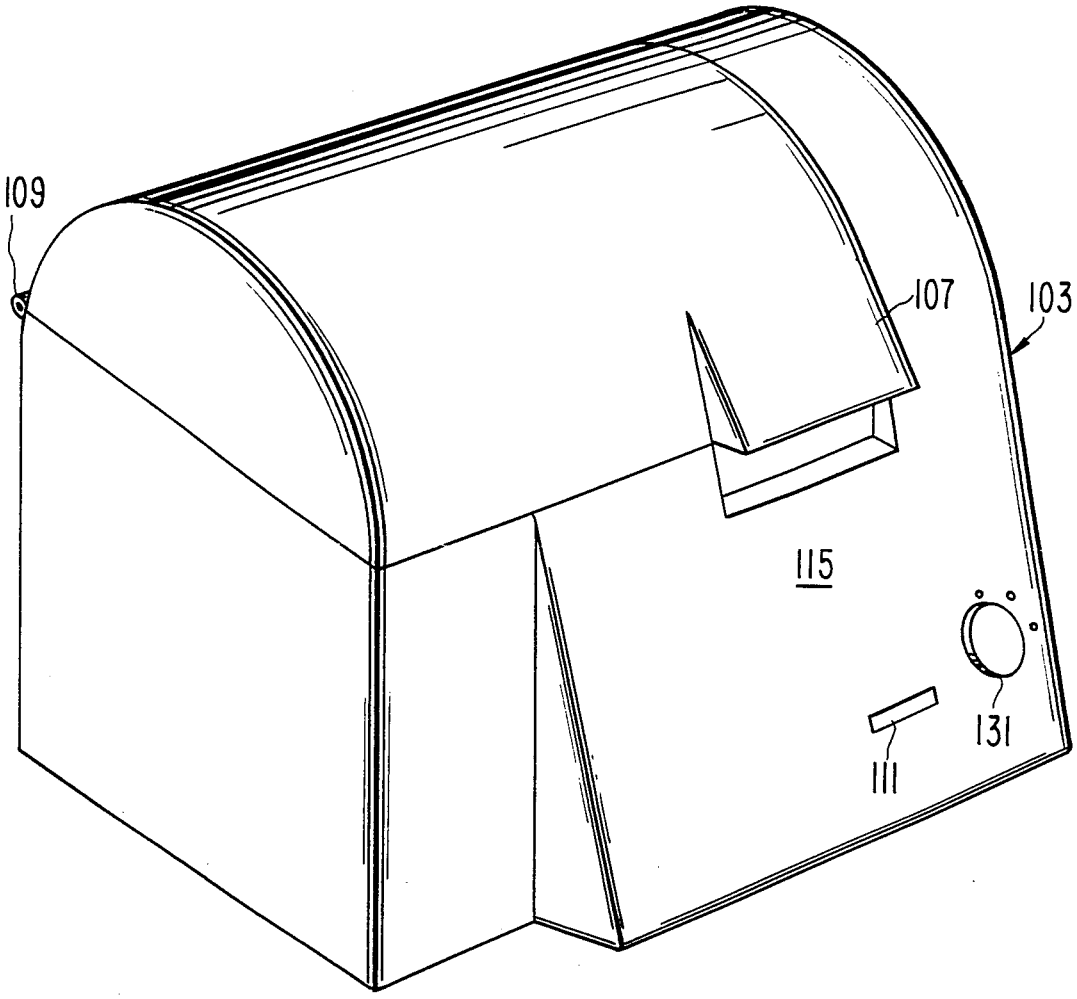
Figure 17:
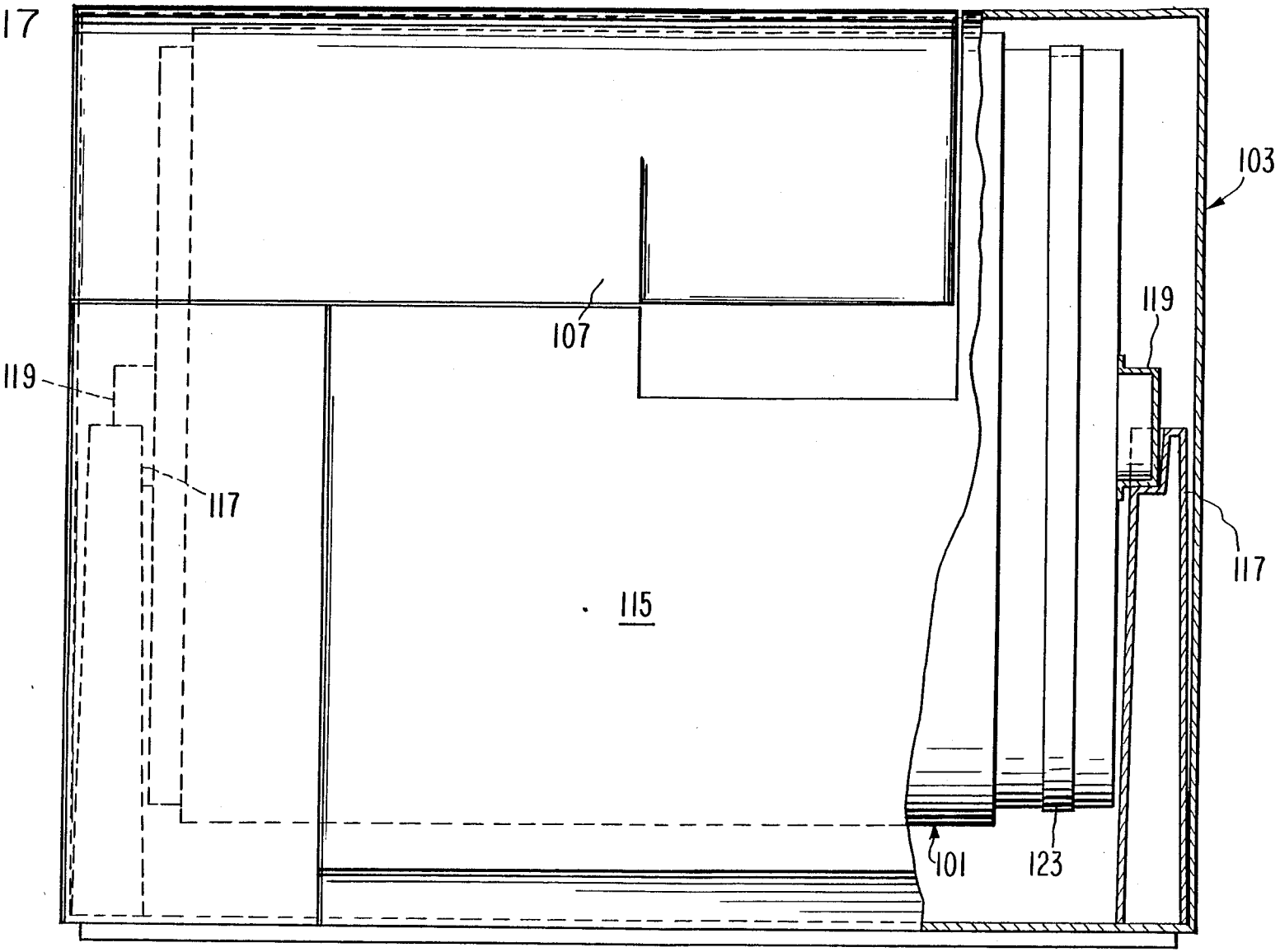
Figure 18:
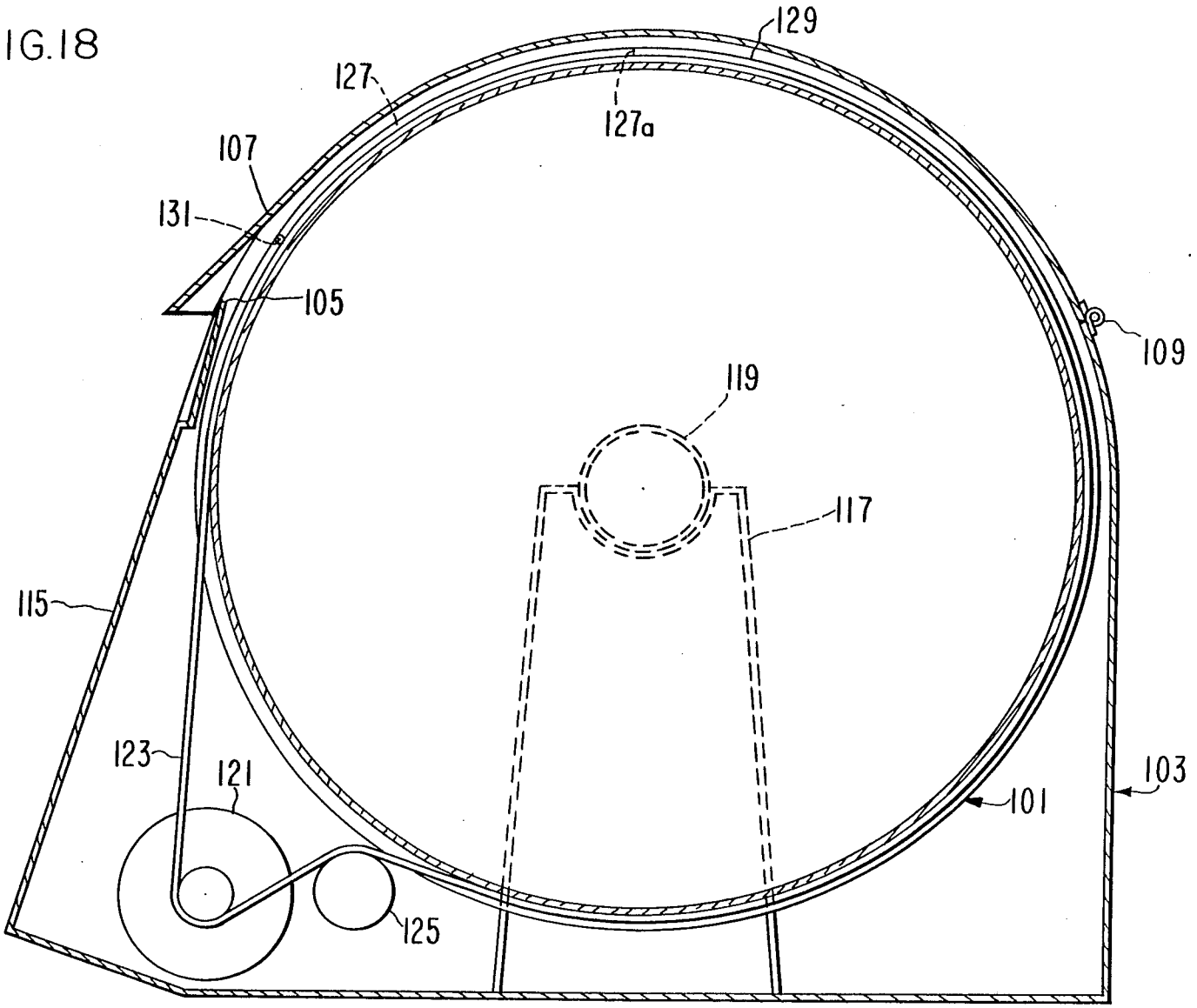

FIG. 16 is a view similar to FIG. 15 but showing a rotary drive apparatus having a top opening;

FIG. 17 is a side elevational view of the apparatus of FIG. 16;

FIG. 18 is a vertical section through one end of the apparatus of FIG. 16.

Figure 19:
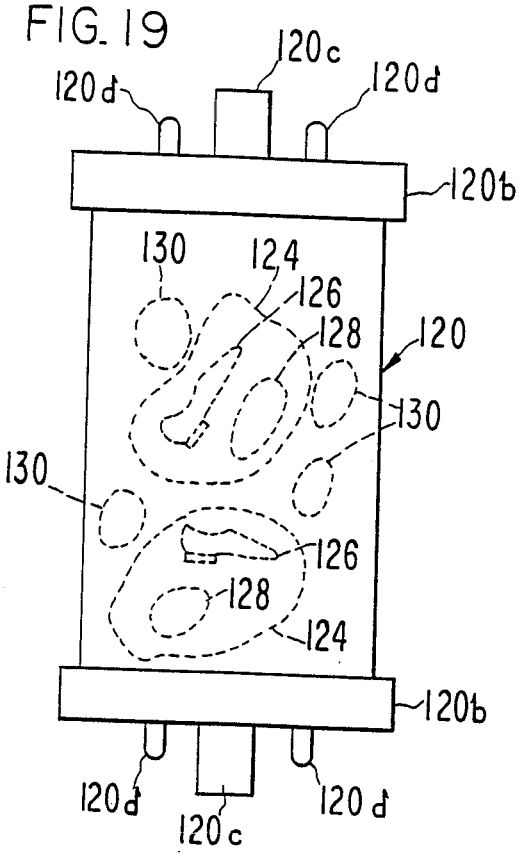
Figure 20:
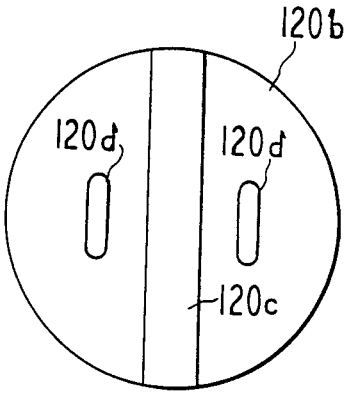
Figure 22:
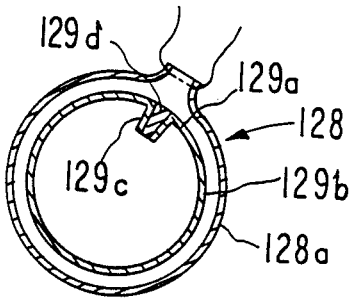
Figure 21:
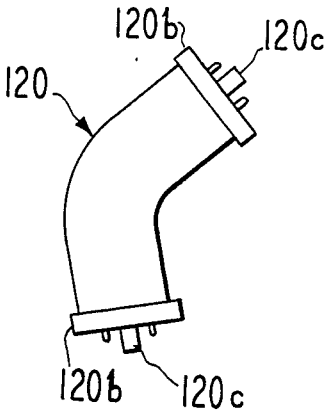

FIG. 19 is a side elevational view of an improved container for placement in a rotary bin or drums for buffing an article in a bag;

FIG. 20 is an end elevational view of the container of FIG. 19;

FIG. 21 is a view similar to FIG. 19 but on a reduced scale, showing the way the container is flexed to permit insertion of the container in a rotary bin;

FIG. 22 is a cross-sectional view of a buffing element of soft vinyl material for placement in a bag carrying an article to be buffed.

The buffing apparatus of the present invention will be described with respect to the buffing of shoes. However, it is understood that the apparatus is suitable for buffing other articles as well.

A first embodiment of the buffing apparatus of the present invention is broadly denoted by the numeral 10 and includes a container 12 having a side wall 14, a bottom wall 16, and a lid 18 comprised of a pair of hinged lid members 20 and 22 hingedly coupled to the upper margin of side wall 14. Container 12 can be of any shape; typically side wall 14 is cylindrical so as to present a circular bottom wall 16 and a circular lid 18. The lid can be kept closed by a fastener device 24 of any suitable construction, such as one made of Velcro material.

The article to be buffed is placed in a flexible bag 26 having an open top 28 (FIG. 2) and a draw string 30 removably closes the open top in the manner shown in FIG. 1. For purposes of illustration, bag 26 can be a fabric material. The bag is larger is size than the shoe.

The bag can contain one or more buffing elements 34. If more than one element is used, the elements are generally of the same size and construction, although they could differ from each other, if desired. Each buffing element 34 is shown in more detail in FIG. 2*a*. It includes a hollow body 36 made of a flexible material, such as rubber, which has stopper means for holding a material, solid or liquid therein. For purposes of illustration, element 34 has a neck 38 through which a fluid, such as air or water, can be directed. A stopper 40 is removably coupled to neck 38 to close body 36 to retain the fluid therewithin. Other forms of stopper means can be provided, if desired.

A layer 42 of buffing material is on the outer surface of body 36. The outer surface of layer 42 is of a material suitable for buffing shoe 32 when container 12 is placed in a rotary bin and rotated in a manner to be described. The material suitable for layer 42 can be the usual cloth or fabric material used for shining shoes. It can have a pile or mat on a fabric base or it can have bristles as is well known in materials for shining shoes. The material used in conventional panty hose is also suitable for this purpose. The layer 42 is loosely placed over body 36 or is secured in any suitable manner, such as by an adhesive, to body 36. Body 36 will generally have a specific size and outer surface area so that it will properly buff the outer surface of the shoe to make the shoe surface shine to a high gloss.

In use, a shoe to be buffed is first placed in bag 26, following which one or more elements 34 are also placed in the bag. A polish or wax may be applied to the shoe, if desired. For purposes of illustration, four elements 34 are shown as being used in FIGS. 1 and 2. The size of the bag is such that it allows substantially free relative movement between elements 34 and the shoe 32 so that elements 34 can move about and buff different portions of the shoe simultaneously and in a random fashion. When, the drawstring 30 is pulled to close the open top 28 of bag 26, the bag is then ready to be placed in container 12 for tumbling or spinning in a rotary bin.

After bag 26 has been placed in the container, the lid of the container is closed and releasably held as shown in dashed lines in FIG. 1. Then the container is placed in a shiftable bin, such as in the drum 44 of a conventional rotary clothes dryer 46 (FIG. 3) having a front opening 48 and a door 50 hingedly mounted on the front wall 52 of the dryer. FIG. 3 shows container 12 in rotor 44 before door 50 has been closed and before the start of rotation of the drum 44 about its rotational axis 54.

After the door 50 has been closed, the clothes dryer is actuated to cause rotation of the drum 44 about axis 54. Container 12 will freely tumble about within the drum and, as it does, the bag 26 will move randomly about within the container. As the bag moves within the container, elements 34 are caused to 30 move relative to the shoe which also moves relative to and within the bag. As a result the shoe will be buffed by the buffing elements at all locations on the outer surface portions of the shoe. The shoe will be shined to a high gloss condition, such as after a certain period of time, such as 5 to 10 minutes of rotation of drum 44.

After a predetermined time period of rotation of drum 44, the rotation is stopped and the container is removed from drum 44, whereupon the container is opened and the bag 26 is removed. The shoe can be removed from the bag and replaced by another shoe for buffing.

While a single shoe has been shown as being contained in the bag 26, the bag can be large enough so that it will accommodate two shoes for simultaneous buffing by one or more elements 34. Moreover, the inner surface of the bag 26 can be provided with a buffing material so that, when the shoe contacts such inner surface of the bag, it will be buffed by the bag as well as by elements 34; thus, the bag and the elements will cooperate with each other during the buffing operation.

Elements 34 provide a certain amount of weight, especially if the elements contain a weight such as water or buckshot, to assure that there will be sufficient frictional engagement between the elements and the shoe to be buffed. Thus, with the added weight provided by elements 34, the outer surface of the shoe can be properly buffed so as to provide an attractive shine for the shoe when the shoe is removed from bag 26.

While many different types of leather articles can be buffed by unit 10, metallic articles, such as articles of silverware, can also be buffed by unit 10. Thus, the invention is not limited to shoes, although it is especially suitable for buffing shoes.

A typical length of container 12 is 24 to 27 inches, and a typical diameter of the container is 12 to 14 inches. These dimensions will give adequate space in the container to allow bag 26 to move about in the container as the container is rotated by drum 44. Moreover in bag 26, shoe 32 moves constantly into different orientations. Typically, it will remain in a position extending longitudinally of the bag. It will, however, tend to rotate longitudinally within the bag. As it does, the various outer surface portions of the shoe are contacted many times by the outer surfaces of each element 34, thus causing a frictional engagement between the shoe and the element which causes the outer surface of the shoe to be buffed and thereby shined.

Another embodiment of the buffing unit of the present invention is broadly denoted by the numeral 60 and includes a container 62 having an outer side wall 64 of a suitable flexible material, such as a layer of canvas material. The container has a lid 65 comprised of a pair of hinged lid elements 66 and 68 which removably close the open top of the container.

A layer 70 of cushioning material, such a plastic foam, is adjacent to the inner surface of side wall 64. A circular bottom layer 72 of cushioning material covers the bottom wall 74 of container 62. Similarly, a circular member 76 of cushioning material is removably mounted in the open top of container 62.

Layers 78 of buffing material are secured to the inner surfaces of cushioning layers 70, 72 and 76. The buffing material can be a fabric provided with a pile or bristles for buffing an article in container 62. The material can be of the same material as used in panty hose. Any other suitable buffing material can be used for this purpose.

In use, a shoe 80 to be buffed is placed in the container 62 and layer 76 is placed over the open top, following which lid element 66 and 68 are closed. Velcro layers 82 can be used to keep the lip elements in their closed conditions. The shoe may or may not have a polish or wax applied thereto.

Then the container is loosely placed in a shiftable bin, such as drum 44 of rotary clothes dryer 45 (FIG. 3). When the drum is rotated about its central axis 54, the container is caused to tumble about within the drum and, as it does, shoe 80 (FIG. 4) moves freely about in the container and frictionally engages the buffing material defined by layers 78. FIG. 4 shows in dashed lines the different positions which shoe 80 might assume as it freely and randomly moves about within and relative to container 62.

It may be desirable or deemed necessary to add weight to the shoe 80 to provide a greater frictional engagement of the shoe and buffing material and thereby a more effective buffing action. This will reduce the time during which container 62 is rotated by drum 44 to provide a desired shine on shoe 80. To this end, shoe 80 can, as shown in FIG. 7, be provided with a shoe tree 83 to add weight to the shoe itself. If additional weight is required, individual weights 85 (FIG. 7) can be added to the shoe tree 83 in any suitable manner. In the alternative, the shoe tree itself can be removed and the weights placed in the shoe and held therein in any suitable manner, such as by a masking tape or other fastener means.

FIG. 8 shows a pair of shoes 80 which are coupled together by a bracket 87 and held in sole-to-heel relationship. Then, both shoes, when coupled together, can be placed in container 62 and remain coupled together as the shoes move about and as the container 60 tumbles in drum 60. Generally, weight is not needed to be added to either shoe if they are coupled together in this manner because the combined weight of the shoes is sufficient to provide a good buffing action in a minimum of time.

It may be desirable to add one or more buffing elements to container 62 to increase the buffing action on shoe 80. These buffing elements are movable randomly in the container and can be of different sizes and shapes. FIG. 9 shoes a ball-shaped buffing element 87 having an outer surface 89 provided with a buffing material, such as one having bristles. The interior of element 86 may be hollow and provided with lead shot, water or other weight therein to provide a more effective buffing action on the shoe.

FIG. 10 shows a buffing element 91 which is in the form of a rectangular pad which is generally flexible so that it can conform to the surface of a shoe when it is adjacent to the shoe during tumbling of the shoe within container 62. Typically, there can be one or several ball-shaped elements 87 and/or one or several pad-shaped elements 91 in container 62 along with shoe 80.

FIG. 6 shows container 62 held by a spring-biased strut 63 in drum 44 so that the container is against the inner periphery of drum 44 at all times during rotation of the drum. This will assure that the article in the container to be buffed will move along a circular path about the central axis 54 of the drum and thereby caused to roll and tumble about in container 62 in a manner designed to cause the desired buffing action in a minimum of time.

FIG. 11 shows container 62 within drum 44 when the drum has an inflatable member 65 therewithin for covering the inner peripheral projections 67 normally found on the drum of a clothes dryer. The use of member 65 is for the purpose of reducing damage to the container in the rotor such as might occur when the container strikes the projections time after time during the rotation of the drum. Member 65 can be of any flexible material, such as rubber and can be inflated by air under pressure to a size to cause the member 65 to cover the projection normally found in a rotary clothes dryer, as shown in FIG. 11. FIG. 12 shows container 62 in the drum 44 when there is no such member 65 in the drum and when the axis of the drum is substantially parallel to the axis of the container.

FIG. 13 shows container 62 in drum 44 when the container is fixed at an angle to the central axis 54 of the drum. The end margins of container 62 are held by braces 69 so that the longitudinal axis of the container 62 extends transversely of and at an acute angle with respect to axis 54.

FIG. 14 shows a view similar to FIG. 3 except that the length of the container with respect to the diameter of the rotor is relatively large, larger than the corresponding length and diameter of the container 12 shown in FIG. 3. This feature provides for an increased distance of travel for the shoe in the container in FIG. 14, thereby providing a greater buffing action, if such is desired.

FIG. 15 shows a rotary drum 100 in a housing 102 having a motor 104 coupled by a flexible belt 106 to the drum to rotate the drum about a generally horizontal axis. Housing 102 has a front door 108 which closes the front, open end of drum 100. A coin slot 110 is adjacent to a timing knob 112 and a coin-actuated mechanism (not shown) is coupled to motor 104 to actuate the motor. The motor will not operate unless coins of a particular amount are placed in coin slot 110 and timer 112 is set to a predetermined time interval.

When door 108 is opened, a shoe or pair of shoes can be placed in the drum for buffing. The shoes to be buffed are placed in a bag and a container in accordance with the teachings of FIG. 1 or in a container alone in accordance with the teachings of FIG. 4. After the door is closed, a coin is placed in slot 110 to energize motor 104. The motor will operate to rotate drum 100 for a certain period of time, during which time period the shoes will be buffed to a desired gloss. When the time period has elapsed, the door is opened and the container is removed and then the shoes are removed from the container, ready to be worn.

Bag 124 can be of any suitable buffing material but is preferably a stretch fabric which is washable, such as one having 87% nylon and 13% Lycra with a 210% stretch in length and a 75% stretch in width. Such a material is available from J. P. Stevens Company, 1185 Avenue of the Americas, New York, N.Y. 10018 and is identified as DK1618. The same material can be used to form a sock or layer for covering element 128.

Preferably, each element 128 is made from a flexible, hollow soft vinyl body, such as one having the shape of a ball, with the body having a hole provided with a removable plastic plug for filling the body with a weight material, such as water, lead shot or the like. A typical diameter of each body is 3 to 4 inches and the body can be packed without the weight in it to minimize shipping costs. Vinyl balls suitable for this purpose are available from Funtaico, 28976 Hopkins Street, Hayward, Calif.

FIGS. 16–19 show a rotary drum 101 in a housing 103 provided with a top opening 105 (FIG. 18) which is covered by a lid 107 pivotally mounted by hinge means 109 on housing 103. Drum 101 and housing 103 are adapted for commercial use and the housing has a coin slot 111 coupled to a coin-actuated mechanism (not shown) and a timing knob 113 on the side 115 of housing 103.

The housing includes a pair of end supports 117 (FIGS. 17 and 18) for mounting a pair of stub shafts 119 for rotation about generally horizontal axis through the central axis of drum 101. The drum has a side opening **127*a* which is removably covered by a sliding panel 127 (FIG. 18). The panel 127 is movable into the space 129 circumferencially of drum 101 when it is desired to open the drum to replace an article to be buffed into the drum or to take the article out of the drum. The channel 127 has the same curvature as of the rest of drum 101, and the drum is provided with any suitable slide means (not shown) to allow circumferencial movement of panel 127 relative to the drum to open and close the opening the side of the drum. As suitable fastner 131 can be provided to releasably lock the panel in place shown in FIG. 18**.

When panel 127 is opened, shoes, can be placed in the drum for buffing. The shoes to be buffed are placed in a bag or a pair of bag or pair of bags in accordance with the teachings above. After the panel has been closed, a coin is placed in slot 111 to energize motor 121. The motor will operate to rotate drum 101 for a certain period of time, during which the shoes will be buffed to a desired gloss. When the time period has elapsed, the panel 127 is moved to an open position and the bag or bags are removed, then the shoes are removed from the bags, ready to be worn.

Another embodiment of the container of the invention is shown FIGS. 19–21 and includes a cyclindrical container 120 which is adapted to be removably placed in a shiftable or rotatable bin, such as the drum of a conventional rotary clothes dryer. Container 120 is formed of a suitable plastic material which permits the container to be bent in the middle as shown in FIG. 121 so that the container be easily placed in and taken out of a clothes dryer, such as the one shown in FIG. 3. To this end, the container has a cylindrical side wall **120*a* with a pair of open ends. The material of wall 120*a* is relatively semi-rigid, but it can be bent as shown in FIG. 21** so as to shorten the distance between the ends of the container.

Container 120 has a pair of end caps **120*b* which are removably mounted on the ends of the cylindrical side wall 120*a*, each end cap closing the corresponding opening of the container and being provided with a resilient, plastic bar 120*c* for bearing against the inner surface of drum which receives container 120. The end caps may be provided with spaced projections 120*d* to form recesses for receiving projections on the inner surface of the drum, such as projections 67 (FIG. 12**).

Container 120 is adapted to removably receive a one or a pair of flexible bags 124, each bag adapted to removably receive an article 126 to be buffed, such as a shoe, and one or more buffing elements 128 in the bag. Additional buffing elements 130 which are typically similar to element 128 are placed in containing 120 outside of bag 124. Typically, a second bag container an article 126 to be buffed and an element 128 is also in container 120 since the container is large enough to accommodate the two bags containing articles to be buffed. Each buffing element 128 is of a soft vinyl material and is in the form of a hollow ball or hollow member which can contain a weight material such as water, lead or the like. The vinyl material of the ball or member is provided to allow for draping of the element 128 or 130 over an adjacent surface if the ball or member is not fully filled with the weight material such as water. On the other hand, the ball or hollow member can be filled with the weight material so that there will be minimal drapping of the ball or member to provide for added buffing if such is deemed necessary or desirable.

Each element 128 includes a spherical or other side wall **129*b* which has a hole 129*c* for receiving a plug 129*d*. The plug fills the hole after the weighted material, such as water, has been placed in the element 129*a*. Any squeezing of the balls tends to improve the seal between the ball 129*e* and plug 129*d* and thereby provides a positive closure or seal for the weight material inside the element 129*a***.

A buffing material is on the outer surface of each element 128. The buffing material is preferably in the form of a small bag **128*a* which receives the ball and has a drawstring which is tied in a knot after the ball is in the bag. The knot also serves as a buffing part. Elements 130 do not need bags as do elements 130** can be provided with bags if desired.

Bag 124 may be provided with drawstrings for closing and opening the bag. The bag is large enough to permit relative movement between the article to be buffed and the buffing element 128 therein.

In use, container 120 is opened by removing one of the end caps **120*b*. Then the bags 124 containing articles 126 to be buffed are placed in the container 120 along with a buffing element 128, and each bag 124 has one or more elements 130 in the container externally of the bags 124. Typically there Will be 3 to 6 elements 130 in the container 120. The end cap 120*b* is placed over the container 120, closing the ends thereof. Then the container is inserted into a rotary bin, such as a rotary clothes dryer. Then the bin is rotated and the bags 124 are tumbled in 120**.

During the rotation of the drum, bags 124 will move about randomly within the container. Moreover, shoes 126 and elements 128 will move randomly within bags 124 and the shoes will be buffed both by the material of the bag and by the external buffer material on the elements 128. Following the expiration of a predetermined period of time, the drum rotation is stopped and the container 128 is removed from the bin, the bag 124 is removed from the container and the shoes 126 are removed from the bag 124.

I claim:

1. Buffing apparatus comprising:

an elongated container for receiving an article to be buffed, said container adapted to be placed in a shiftable bin having an opening and to be moved about in the bin relative to a predetermined reference as the bin is shifted, said container having a side wall capable of being flexed to shorten the length of the container to permit it to be inserted in the bin through said opening, there being a buffing element in the container, said element having a buffing material thereon frictionally engageable with the article in the container, said container being of a size to permit the article therein to move relative to the buffing element and the container as the container is moved relative to said reference.

2. Apparatus as set forth in claim 1, wherein is included a flexible bag of buffing material for placement into the container the bag adapted to receive the article and the buffing element, the bag, the article and the buffing element being movable within and relative to the container, there being a second buffing element in the container externally of the bag, said second element being movable within and relative to the container.

3. Apparatus as set forth in claim 2, wherein each of the buffing elements comprises a body, the first-mentioned buffing element having a layer of buffing material covering the outer surface of the respective body.

4. Apparatus as set forth in claim 3, wherein each body is flexible and hollow and is provided with a hole therein to permit a weight material to be placed in the element, and a plug for closing said hole.

5. Apparatus as set forth in claim 3, wherein the weight material is water, said layer being of a stretchable fabric.

6. Apparatus as set forth in claim 5, wherein the stretchable material is comprised of a synthetic material.

7. Apparatus as set forth in claim 6, wherein said synthetic material is a combination of nylon and Lycra.

8. Apparatus as set forth in claim 5, wherein the stretchable material has approximately a 210% stretch in length and a 75% stretch in width.

9. Apparatus as set forth in claim 3, wherein each body is a vinyl ball.

10. Apparatus as set forth in claim 1, wherein said container has a cylindrical shape and a pair of ends, and including cap means at the ends of the container for removably closing the container.

11. Apparatus as set forth in claim 10, wherein the cap means includes a cap for each end, respectively, of the container, each cap having a resilient bar for engaging the inner surface of a rotary bin.

* * * * *